US011464372B2

(12) United States Patent
Perkins

(10) Patent No.: US 11,464,372 B2
(45) Date of Patent: Oct. 11, 2022

(54) TOILET DEVICE

(71) Applicant: Constable Group Limited, Colchester (GB)

(72) Inventor: Anne-Marie Perkins, Colchester (GB)

(73) Assignee: CONSTABLE GROUP LIMITED, Colchester (GB)

( * ) Notice: Subject to any disclaimer, the term of this patent is extended or adjusted under 35 U.S.C. 154(b) by 0 days.

(21) Appl. No.: 17/252,180

(22) PCT Filed: Jun. 27, 2019

(86) PCT No.: PCT/GB2019/051827
§ 371 (c)(1),
(2) Date: Dec. 14, 2020

(87) PCT Pub. No.: WO2020/002929
PCT Pub. Date: Jan. 2, 2020

(65) Prior Publication Data

US 2021/0251439 A1 Aug. 19, 2021

(30) Foreign Application Priority Data

Jun. 27, 2018 (GB) ..... 1810530

(51) Int. Cl.
*A47K 11/04* (2006.01)
*A47K 13/06* (2006.01)

(52) U.S. Cl.
CPC ..... *A47K 11/04* (2013.01); *A47K 13/06* (2013.01)

(58) Field of Classification Search
CPC ..... A47K 11/04; A47K 13/06
(Continued)

(56) References Cited

U.S. PATENT DOCUMENTS 2,203,076 A 6/1940 Baxter
3,235,884 A * 2/1966 Rehsteiner ..... A47K 11/04 4/484

(Continued)

FOREIGN PATENT DOCUMENTS

CN 2910760 Y 6/2007
CN 101516244 8/2009

(Continued)

OTHER PUBLICATIONS

Chinese Office Action for Application No. 201980043258.0, dated Nov. 19, 2021 (15 pages, including English translation).

(Continued)

*Primary Examiner* — Huyen D Le
(74) *Attorney, Agent, or Firm* — Foley & Lardner LLP

(57) ABSTRACT

A toilet device (1) comprising a seat portion (2) and a pair of leg portions (6) attached to opposite ends of the seat portion (2), wherein a first end of each leg portion is pivotally attached to its respective end of the seat portion so that the leg portions (6) can be deployed from a first, folded configuration of the toilet device (1), in which each leg portion (6) extends from its respective first end towards a rear of the toilet device (1), towards a second, erect configuration of the toilet device (1) in which each leg portion (6) extends from its respective first end substantially at right angles to the seat portion (2), the leg portions (6) being connected by at least one connecting element (7, 8) pivotally connected to a second of each of the leg portions (6).

12 Claims, 17 Drawing Sheets

(58) Field of Classification Search
USPC ..... 4/483
See application file for complete search history.

(56) References Cited

U.S. PATENT DOCUMENTS

| | | | | | |
|---|---|---|---|---|---|
| 3,495,277 | A * | 2/1970 | Herskovich | A47K 11/04 | 4/237 |
| 4,052,087 | A * | 10/1977 | Gagliardi | A47K 11/04 | 280/650 |
| 4,613,994 | A * | 9/1986 | Oates | A47K 11/04 | 280/304.1 |
| 5,161,263 | A * | 11/1992 | Geneve | A47K 11/06 | 4/239 |
| 6,341,386 | B1 * | 1/2002 | Phillips | A47K 11/06 | 4/479 |
| 2008/0005831 | A1 | 1/2008 | Seo | | |
| 2015/0265109 | A1 | 9/2015 | Capraro et al. | | |

FOREIGN PATENT DOCUMENTS

| | | |
|---|---|---|
| CN | 105979835 | 9/2016 |
| GB | 2184650 A | 7/1987 |
| GB | 2442198 A | 4/2008 |

OTHER PUBLICATIONS

International Search Report and Written Opinion on PCT Application No. PCT/GB2019/051827, dated Sep. 26, 2019 (13 pages).

* cited by examiner

TOILET DEVICE

CROSS-REFERENCE TO RELATED APPLICATIONS

This application is a U.S. National Stage Application under 35 U.S.C. § 371 of International Patent Application No. PCT/GB2019/051827, filed on Jun. 27, 2019, which claims priority to Great Britain patent application no. 1810530.4, filed on Jun. 27, 2018, the disclosure of each of which is incorporated herein by reference in its entirety.

TECHNICAL FIELD

Embodiments of the present invention generally relate to toilet devices, and in particular to portable potties suitable for travel.

BACKGROUND

Travel potties are known and include foldable devices, usually comprising a seat component and foldable legs attached to the seat component. An example of such a foldable device is disclosed in GB2442198B. In a folded position, the legs of this device are folded inwardly under the seat component. In use, the legs are folded down and a bag is fitted over the seat component, so that any waste is collected in the bag. After use, the bag can be tied up and disposed of, while the legs of the travel potty are folded back again, inwardly under the seat component.

A disadvantage associated with such foldable devices is that they are less stable compared to standard potties and a child may not feel at ease when encouraged to use it. Furthermore, such devices, when in folded position are not ready for immediate use. Setting up such devices is not easy nor quick to deploy, often requiring a parent of child-carer to frantically use both hands to unfold each leg of the potty, then find the locking position of the legs by forcing them into position before it can be sat upon and finally fit the waste collecting bag, whilst the child is left to wait.

It is to these problems, amongst others, that embodiments according to the invention attempt to offer a solution. In particular, it is desirable to provide a toilet device suitable for travel, that is fast and convenient to deploy whilst maintaining high levels of stability.

SUMMARY

In an independent aspect, there is provided a toilet device comprising a seat portion and a pair of leg portions attached to opposite ends of the seat portion, wherein a first end of each leg portion is pivotally attached to its respective end of the seat portion so that the leg portions can be deployed from a first, folded configuration of the toilet device, in which each leg portion extends from its respective first end towards a rear of the toilet device, towards a second, erect configuration of the toilet device in which each leg portion extends from its respective first end substantially at right angles to the seat portion, the leg portions being connected by at least one connecting element pivotally connected to a second end of each of the leg portions.

The seat portion has a length extending between its opposite ends. The seat portion also has opposite sides extending co-directionally with the length between the opposite ends. The term "attached to opposite ends of the seat portion" therefore does not mean that the leg portions are attached to the opposite sides of the seat portion.

Advantageously, the connecting element between the leg portions provides increased stability to the device and can maintain a constant distance in use between the feet portions of the legs for example. Accordingly, the leg portions may be substantially parallel to each other at all times. This enables the device to be deployed very quickly, since the leg portions unfold together, simultaneously, downwards, aided by gravity. Advantageously, a user only requires one hand to unfold the legs, in contrast to prior art devices where the legs are independent from each other and they each have to be unfolded. Advantageously, the seat portion is well balanced and stable in the erect configuration because the first ends of the leg portions are connected to opposite ends of the seat portion.

In a subsidiary aspect, the at least one connecting element comprises: a first end attached to the second end of one of the leg portions; and a second end attached to the second end of the other leg portion.

Advantageously, this provides a compact and simplified arrangement. This means that the device is suitable for use as a portable device, and the user can store the device in a travel bag.

In a subsidiary aspect, the leg portions are connected by two connecting elements substantially parallel to the seat portion. This enables the connecting elements to be in the form of two connecting beams for example, connecting opposing feet of the leg portions (at the respective ends of the leg portions distal to the seat portion). In its unfolded position, in effect, the device rests on the two connecting elements, providing increased stability and robustness.

In a subsidiary aspect, at least one leg portion comprises a locking device or locking mechanism for securing said at least one leg portion into the first and/or second configuration. This increases stability of the device, preventing the device from collapsing whilst erect, and preventing the leg portions from unfolding when in the folded position. It will be appreciated that the locking mechanism may be different for locking the device in the folded and unfolded positions respectively. In preferred configurations, a locking device is located at the rear end of the device to lock/unlock the rear leg portion.

In a subsidiary aspect, the locking device may be arranged to secure the rear leg portion in the first and/or second position. The rear leg portion is the leg portion located closest to the rear of the device.

In a subsidiary aspect, the locking device comprises an operating element and at least one pivotable element having a pin portion for engaging with the underside of the seat portion. For example, the operating element may be a button conveniently located underneath the seat portion, at its rear end (where the user hand is holding the device). Using only one hand, the user can press the button for example unlock the device when in erect position and enable it to fold back to the folded position.

In a subsidiary aspect, the locking device comprises a biasing element for biasing the locking means to secure said pin portion to the underside of the seat portion. For example, the biasing element may be a torsion spring to bias the pin portion in the locked position (e.g. pushing it in an aperture of the pin portion). An operating element such as a button could act against the biasing force to unlock the locking device.

In a subsidiary aspect, the device further comprises a detent means for securing the toilet device in the erect configuration. This increases stability of the device in use. For example, the detent means may comprise an aperture provided in at least one leg portion and at least one protrusion to be received in the aperture, the protrusion provided in the at least one connecting element pivotally connected to said at least one leg portion.

In a subsidiary aspect, said at least one connecting element comprises at least one recess for receiving a bag handle. The recess enables the bag to be secured in place. Preferably, the at least one recess has a depth at least 50% of the height of the at least one connecting element. A deeper recess prevents the bag handle from slipping out.

In a subsidiary aspect, the toilet device rests on the at least one connecting element in the second (erect) configuration.

Advantageously, this provides stability when the device is in the second (erect) configuration, meaning the device is less likely to topple over.

In a subsidiary aspect, the toilet device is a potty.

The term "potty" is to be interpreted to mean a toilet device of a size suitable for a small child to use.

BRIEF DESCRIPTION OF THE FIGURES

Embodiments of the invention will be described by way of example with reference to the Figures, in which.

DETAILED DESCRIPTION

Figure 1:
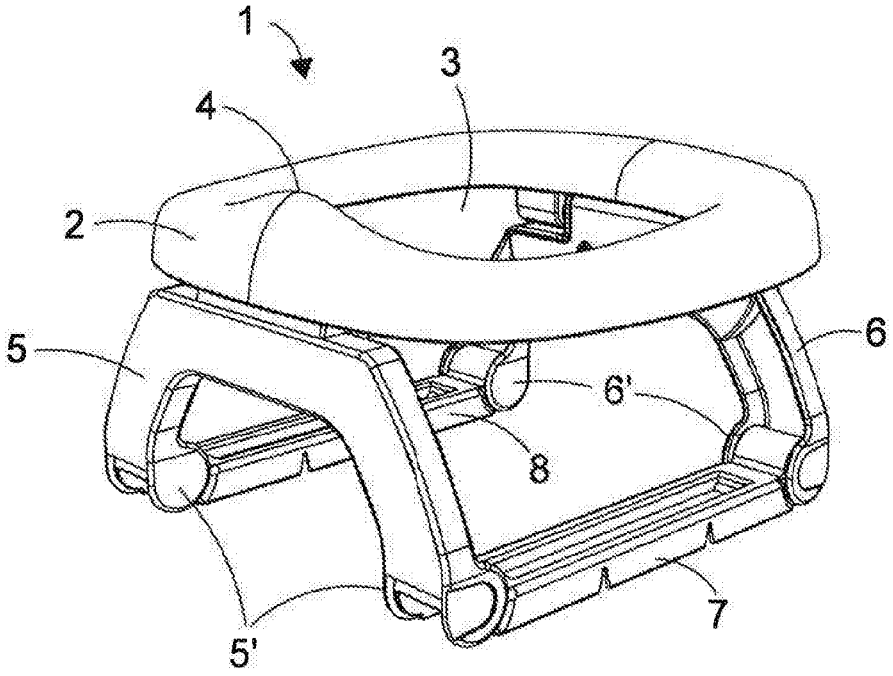
FIG. 1 shows a perspective view of a device according to a first embodiment of the invention in its deployed (unfolded/erect) configuration, from the front.
Figure 2:
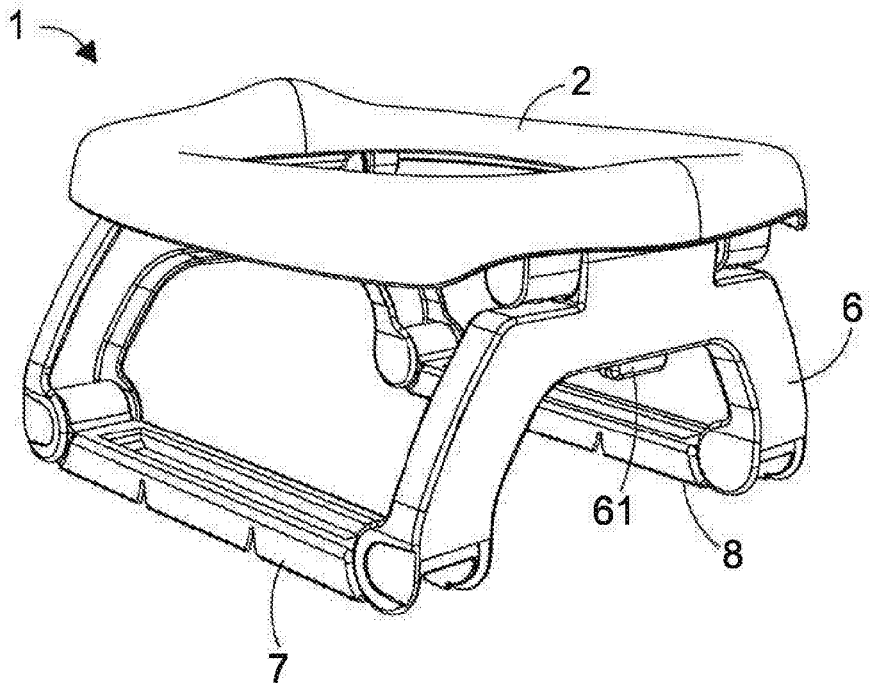
FIG. 2 shows a perspective view of the device of FIG. 1 in the deployed configuration, from the rear.
Figure 3:
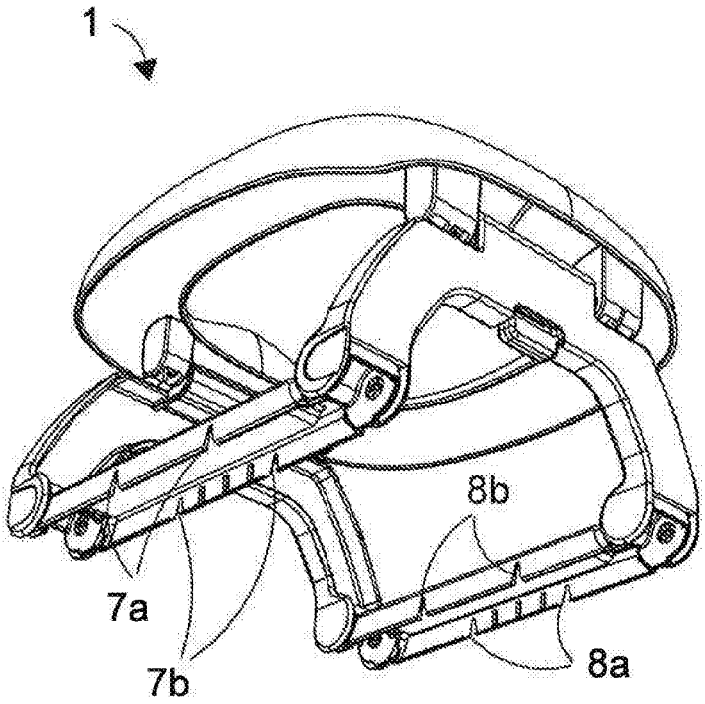
FIG. 3 shows a perspective view of the device of FIG. 1 in the deployed configuration, from below.

With reference to FIGS. 1 to 5, there is shown a toilet device 1 according to a first embodiment of the present invention. The toilet device 1, also referred to as a potty (or portable potty/travel potty), comprises a seat portion 2 which is a generally annular body having a profiled seating surface defining a central opening 3. The seat portion 2 has a raised protuberance 4 defining the front of the toilet device 1.

The seat portion 2 is supported at opposite ends by a pair of leg portions 5, 6 (side walls) of similar shape and substantially equal height. A first end of each leg portion is pivotally attached to its respective end. In the depicted example, each leg portion has two feet portions 5', 6.

Figure 4:
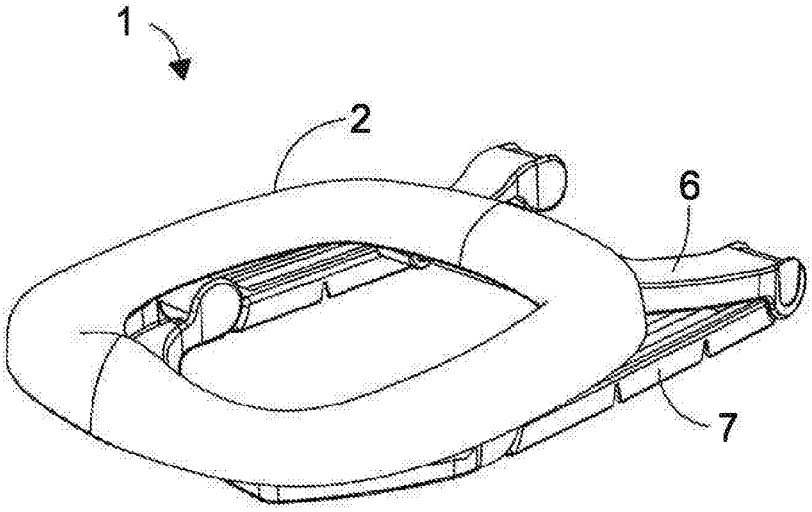
FIG. 4 shows a perspective view of the device of FIG. 1 in its folded configuration.
Figure 5:
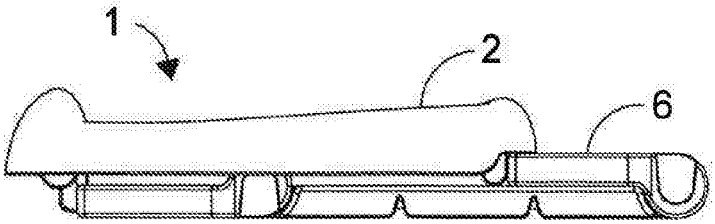
FIG. 5 shows a lateral view of the device of FIG. 1 in the folded configuration.
Figure 6A:
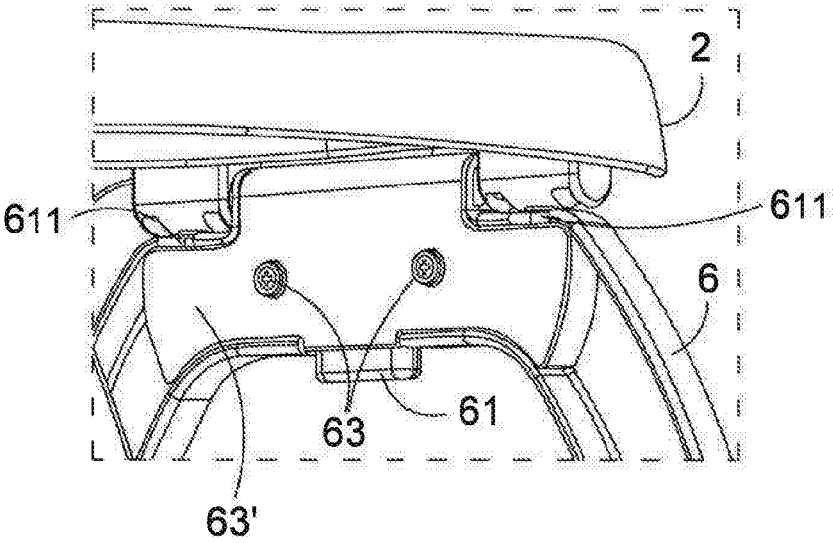
FIGS. 6A and 6B show perspective views of an enlarged scale of a detail of the device of FIG. 1 (from front, and rear, respectively)
Figure 6B:
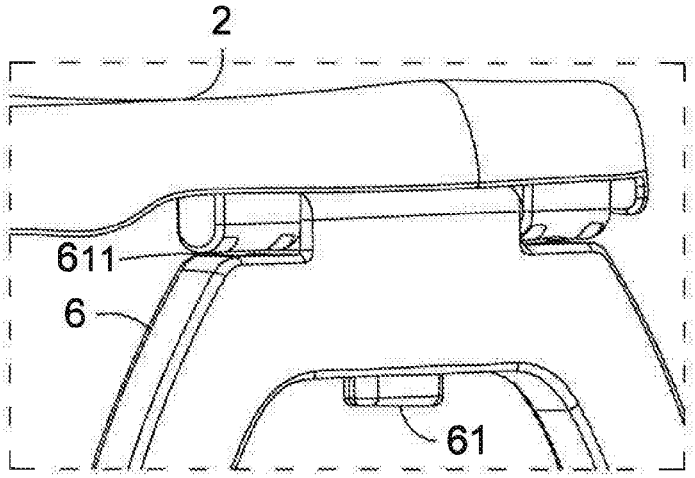

The leg portions 5, 6 are pivotally attached to the seat portion 2 such that they both fold towards the rear of the toilet device 1 as shown in FIGS. 4 and 5. Preferably, the pivotal attachment means is such that the leg portions 5, 6 cannot fold in the opposite direction, towards the front of the toilet device 1. It will be appreciated that this may be achieved in several ways, for example using 'one-way' hinges permitting unfolding in one direction only. For example, the pivotal attachment means may include blocking elements to block the leg portions 5, 6 from folding towards the front of the device. Alternatively, the leg portions 5, 6 may be stopped by the profiling of the seat portion 2 itself.

A second end of each leg portion 5, 6 is pivotally attached to at least one connecting element 7, 8. In the depicted example, the second end of one of the leg portions 5, 6 is pivotally connected to a first end of the connecting element and the second end of the other leg portion is pivotally connected to a second end of the connecting element 7,8. Specifically, in the depicted example, the feet portions 5', 6' are respectively pivotally connected by the connecting element, in this example two supporting beams 7, 8 of substantially equal length. Each of the supporting beams 7, 8, also referred to as braces, are located either end of the toilet device 1 (substantially parallel to the seat portion 1) and provide increased stability such that the toilet device does not wobble in the erect position.

It will be appreciated that having a single connecting element between the front and rear leg portions is also possible. In an alternative configuration for example, the feet portions 5' of a leg portion (on the same end of the device) may be additionally connected to each other by a further connecting element to increase stability. For example, the leg portions 5, 6 can have a D shape or be constructed as a single side wall In such configuration, one or more supporting beams can extend between the front and rear leg portions 5, 6, for example, with further supporting beam connecting the middle of the leg portions.

In the illustrated example, when the leg portions 5 and 6 are folded or unfolded, the supporting beams 7, 8 maintain the leg portions 5, 6 parallel to each other at all times. The overall profile of the leg portions 5,6 and beams 7,8 arrangement can be regarded as a parallelogram, in both folded and unfolded (erect) positions, with the beams 7, 8 being parallel to each other and the seat portion 2. As shown in FIGS. 4 and 5, in the folded configuration, the supporting beams 7,8 are tucked to the either end of the seat portion 2.

The leg portions 5,6 and beams 7,8 arrangement increases the stability of the device 1 and allows the device to be unfolded in a quick manner. In particular, connecting the leg portions 5, 6 allows them to unfold downwards in a synchronised manner, aided by gravity. At all times, the leg portions 5,6 are substantially parallel to each other so that the side profile of the toilet device 1 during the folding/unfolding operation is substantially a parallelogram. The side profile in use therefore may be regarded as a "collapsible parallelogram".

In preferred embodiments, as shown in FIGS. 6A to 9B, the leg portions 5,6 are secured in the folded position by a locking device or locking mechanism 60 included in the rear leg portion 6. In alternative embodiments, the locking mechanism 60 can be provided in the front leg portion 5. The locking mechanism 60 has an operating element or button 61 which, when pressed, unlocks the rear leg portion 6 and gravity allows it to fall (connected to the front leg portion 5), away from the seat portion 2, whilst the supporting beams maintain the relative distance between the front and rear feet portions 5', 6'.

A preferred embodiment of the locking mechanism 60 is now described with reference to FIGS. 7A to 9B. Pressing the button 61 upwards, towards the seat portion 2 of the device, causes at least one pivotable element 62, to pivot around a fulcrum element 63 (a bolt). In this example, there are two pivotable elements 62 swiveling around respective bolts 63, each pivotable element 62 having an upward bolt or pin 64 at the end distal to the button 61 and being activated by the operation of the button 61. In alternative configurations (not shown) the bolt or pins 64 may have alternative orientations relative to the toilet seat portion 2, for example they may be horizontal rather than vertical. In the locked position of the folded configuration (securing rear leg 6 to the seat portion 2 as shown in FIGS. 4 and 5), the pins 61 protrude upwards from the rear leg 6 and engage with the seat portion 2. For example, with reference to FIGS. 6A, 6B, the pins 61 can protrude in corresponding apertures (pin holes) 611 provided in the underside of the seat portion 2. When the button 61 is pressed, the pivotable elements 62 pivot around the bolts 63 causing the pins 62 to move downwards, retracting within the rear leg 6. Accordingly, the pins are disengaged from the seat portion 2, unlocking the rear leg portion 6 which fall downwards, towards the erect position. As explained above, the rear and front leg portions 5,6 move together, being connected by beams 7, 8, forming a "collapsible parallelogram".

A user can quickly unfold the device 1 quickly, with one hand, by a flicking motion. After use, to fold back the device, the user can also unlock the rear leg portion 6 of the folded device 1 with one hand (holding the rear portion of the toilet device 1 and pressing the button 61). It is envisaged that the toilet device can be deployed in the unfolded (erect) position in a matter of seconds, preferably within 10 seconds, more preferably within 5 seconds.

Figure 7A:
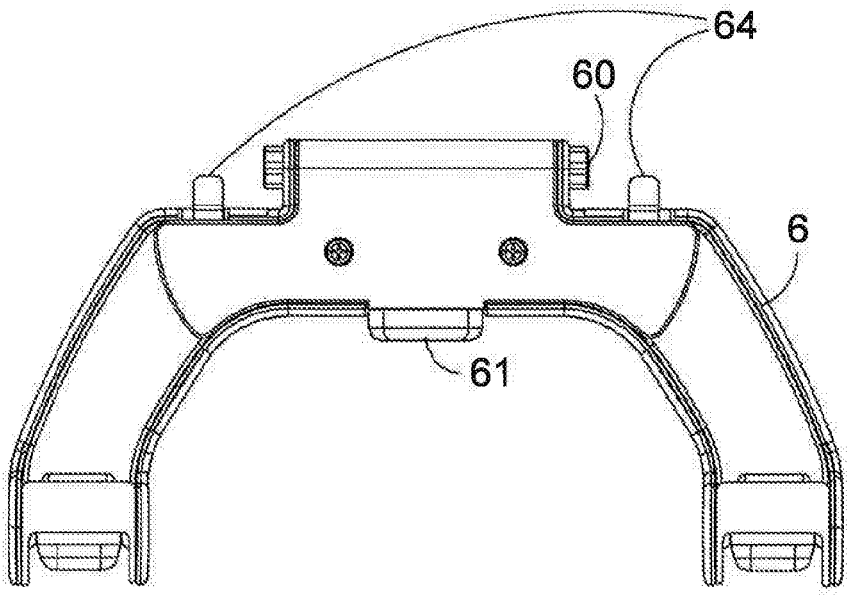
FIGS. 7A and 7B show a locking mechanism of the device of FIG. 1 in two functional positions.
Figure 7B:
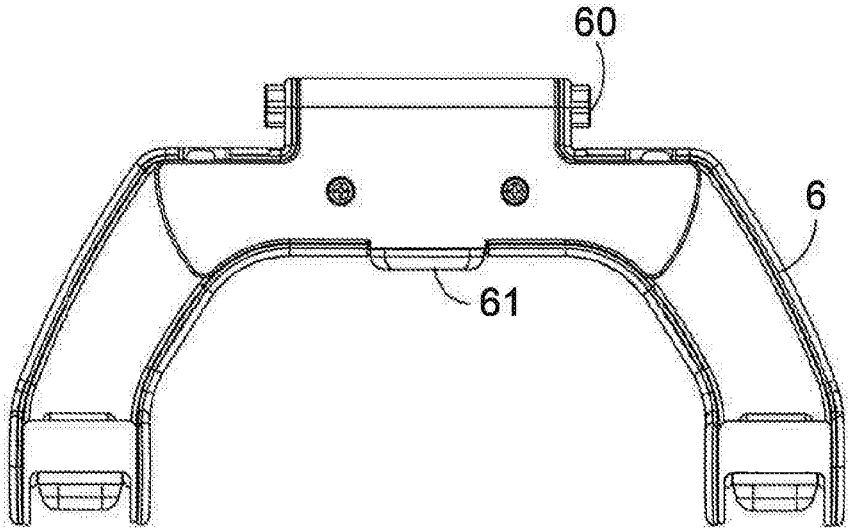
Figure 8:
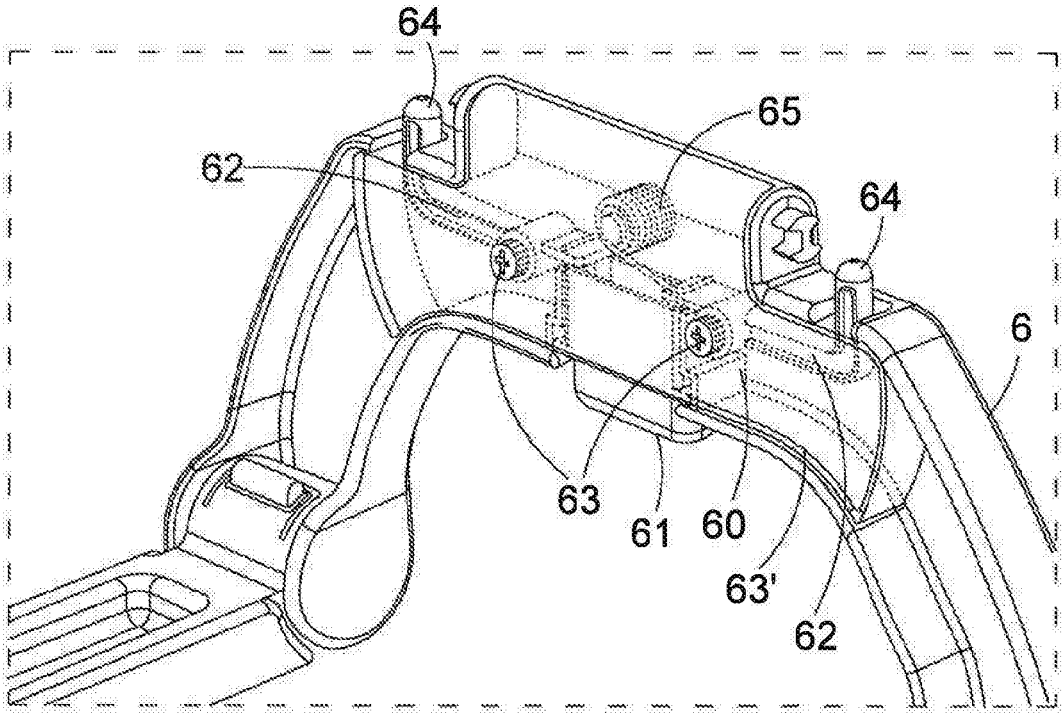
FIG. 8 shows an internal view of the locking mechanism of the device of FIG. 1.
Figure 9A:
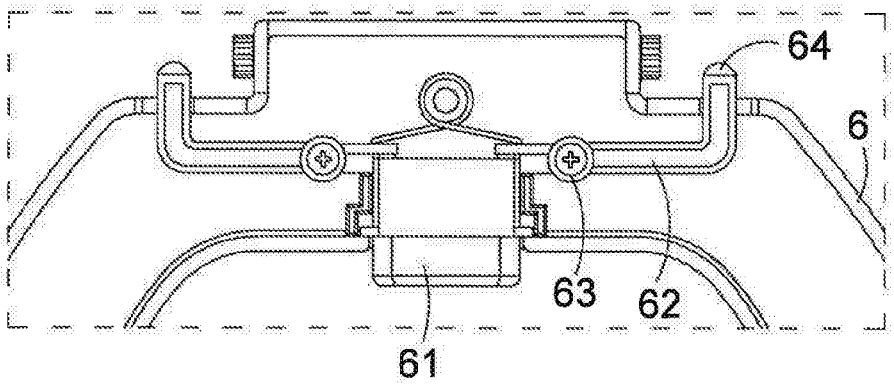
FIGS. 9A and 9B show inner views of the locking mechanism respectively shown in FIGS. 7A and 7B.
Figure 9B:
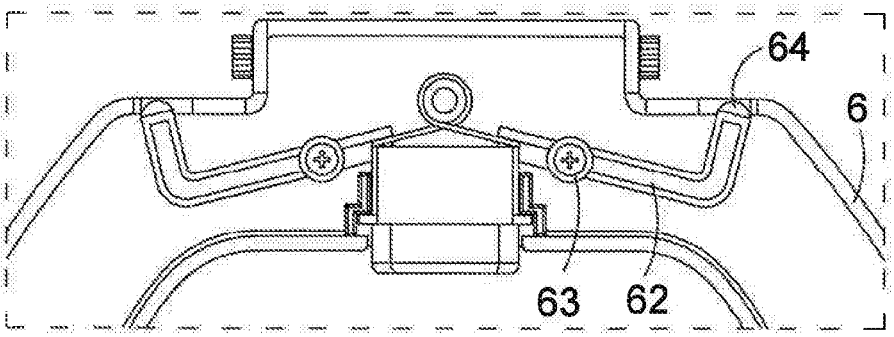

In this example, the operation of the button 61 is against a biasing force acting on the pivotable elements 62. In particular, each of the pivotable elements 62 are biased by a torsion spring 65 (e.g. a metal spring) so that their ends engaging the button 61 (at the middle of the rear leg portion) are biased in a downward position and the pins 64 are biased upwards, as shown in FIG. 7A, FIG. 8, FIG. 9A.

In the erect position, the pins 64 can engage back with the underside of the seat portion, the locking mechanism 60 having a secondary latch for securing the toilet device 1 in the erect position and preventing it from collapsing After use, the toilet device 1 can be unsecured from the erect position, by pressing button 61 and again, with one hand, the device can be folded very quickly with one hand into collapsed closed position). By pushing button 61 the pivotable elements 62 to swivel, retracting the pins 64, therefore disengaging the rear leg portion 6 from the seat portion 2. The leg portions 5, 6 are folded back and the pins 64 engage back with the seat portion 2, locking the toilet device in the folded position shown in FIG. 5 for example.

Figure 10A:
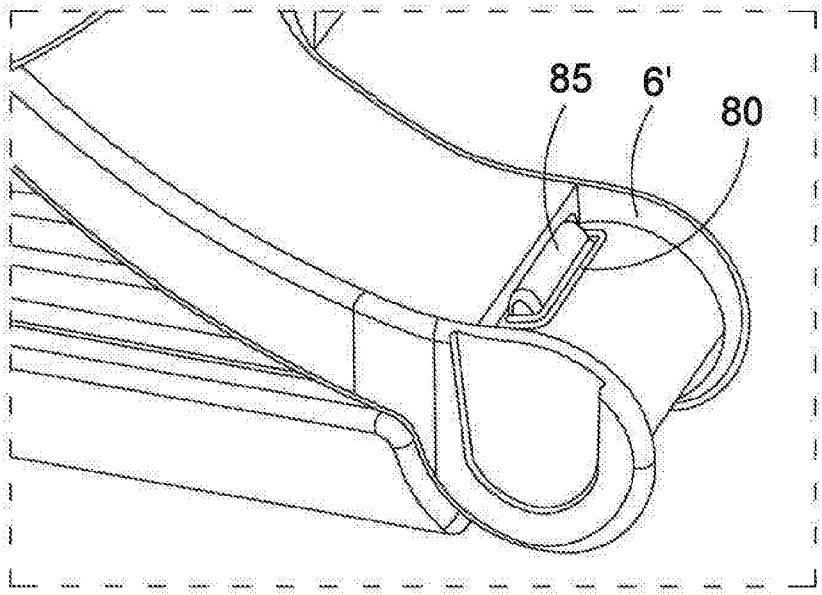
FIGS. 10A to 10C are views of an enlarged scale of a further locking mechanism in one of the legs of the device of FIG. 1.
Figure 10B:
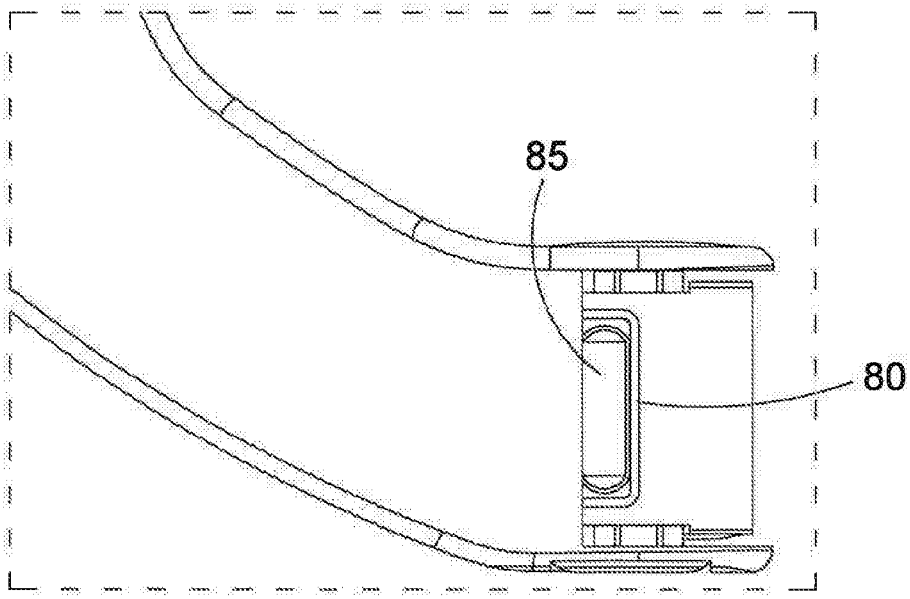
Figure 10C:
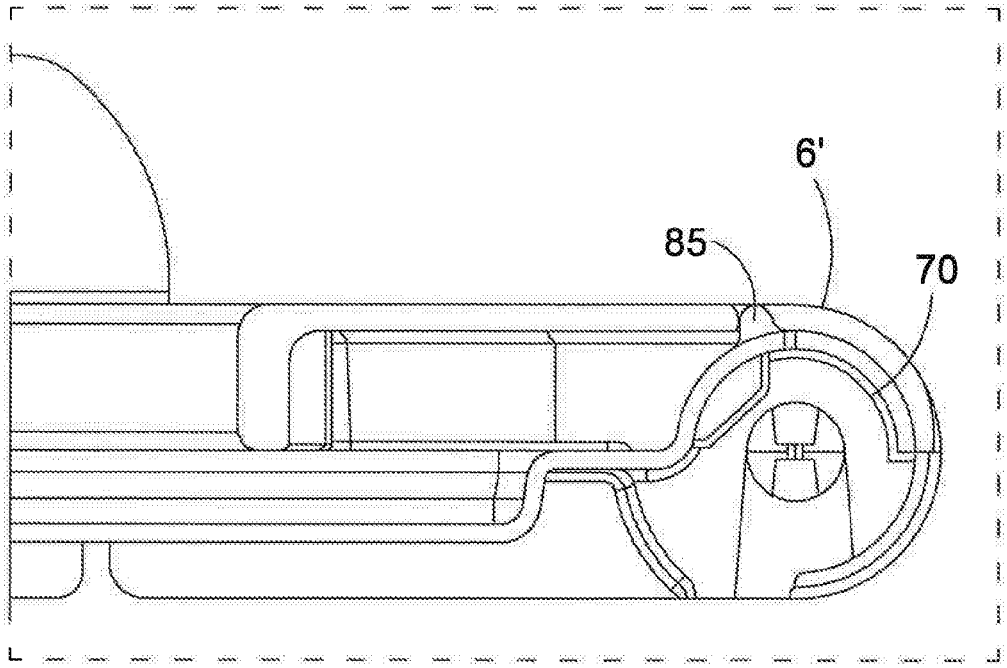

With reference to FIGS. 10A to 10C, a foot portion 6' of the rear leg portion 6 has a rounded portion forming a hinge 70 connected to a connecting element 7. The leg portion 6' has aperture 80 for receiving a protrusion or detent element 85 provided in the hinge 70. Protrusion or detent element 85 prevents gravity from allowing legs to drop thereby forcing rear upright leg portions 5 and 6 to be trapped behind the protrusion. By action of a user applying force, the protrusion 85 is able to be flexed away therefore releasing rear upright and allowing gravity to allow the leg portions 5, 6 to fall. The detent element 85 serves to increase stability of the toilet device 1 in its erect position, by securing the relative position of the beams 7, 8 relative to the feet portions 5', 6'. In this example, each of the four feet portions of the device is provided with detent locking means, although it will be appreciated that this is not essential.

With reference to FIGS. 12 to 16, there is shown a toilet device 100 according to a second embodiment of the present invention. Like the first embodiment, the device 100 includes a seat portion 102, which is supported by a pair of leg portions 105, 106 attached to opposite ends of the seat portion. A first end of each leg portion 105, 106 is pivotally attached to its respective end of the seat portion 102 and the second end of each leg portion is connected to a connecting element 107, whereby the device 100 can be moved between folded and unfolded (erect) positions like in the first embodiment. However, the construction of the leg portions of the second embodiment is different. Specifically, in FIG. 12, one of the leg portions 105, 106 is a side wall, and the other one of the leg portions comprises two leg components 109 extending from a transverse beam (not shown) in FIG. 12. In FIGS. 13 to 16, both leg portions 105, 106 are sidewalls.

The locking mechanism 110 of the device 100 of the second embodiment is also different with respect to the locking mechanism of the first embodiment. However, it will be noted that like the first embodiment the locking mechanism 110 is located at the rear of the device. In other words, when the leg portions 105, 106 are flat and in the folded position the locking mechanism 110 is located at the end of the device to which the leg portions extend towards from the seat portion 102.

Figure 17:
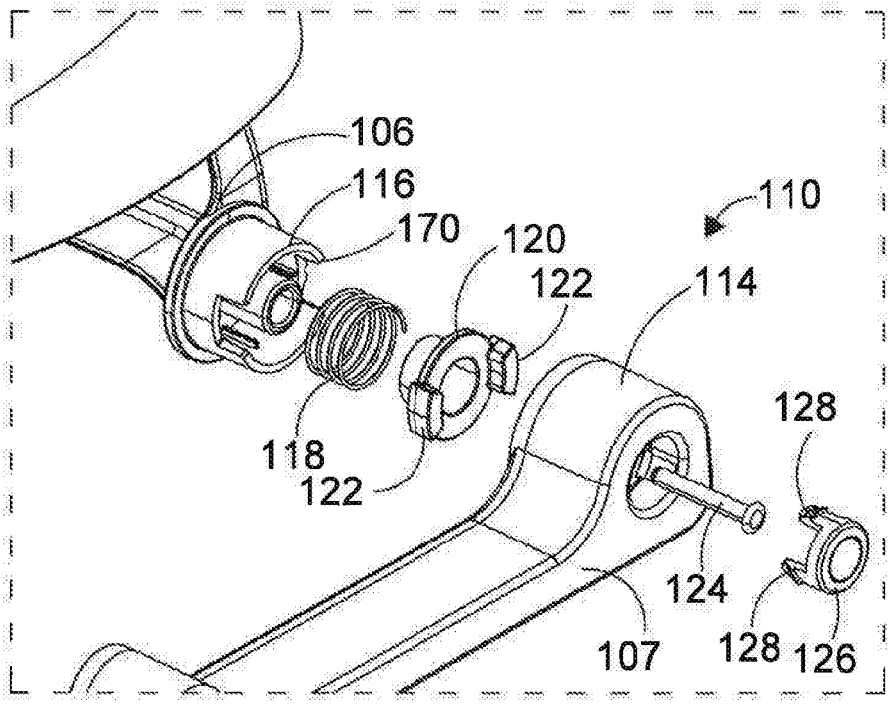
FIG. 17 shows the constituent parts of a locking mechanism employed in the device according to the second embodiment.

The locking mechanism 110 of the second embodiment is shown in greater detail in FIGS. 17 to 24. The constituent parts of the locking mechanism of the second embodiment are shown in FIG. 17. As shown, the locking mechanism 110 comprises a rear leg portion hub 116 provided on the leg portion located closest to the rear of the device 100 (the rear leg portion 106), coiled spring 118, a locking plate 120, a first end of the at least one connecting element 114, a pin 124 and locking button 128.

Figure 18:
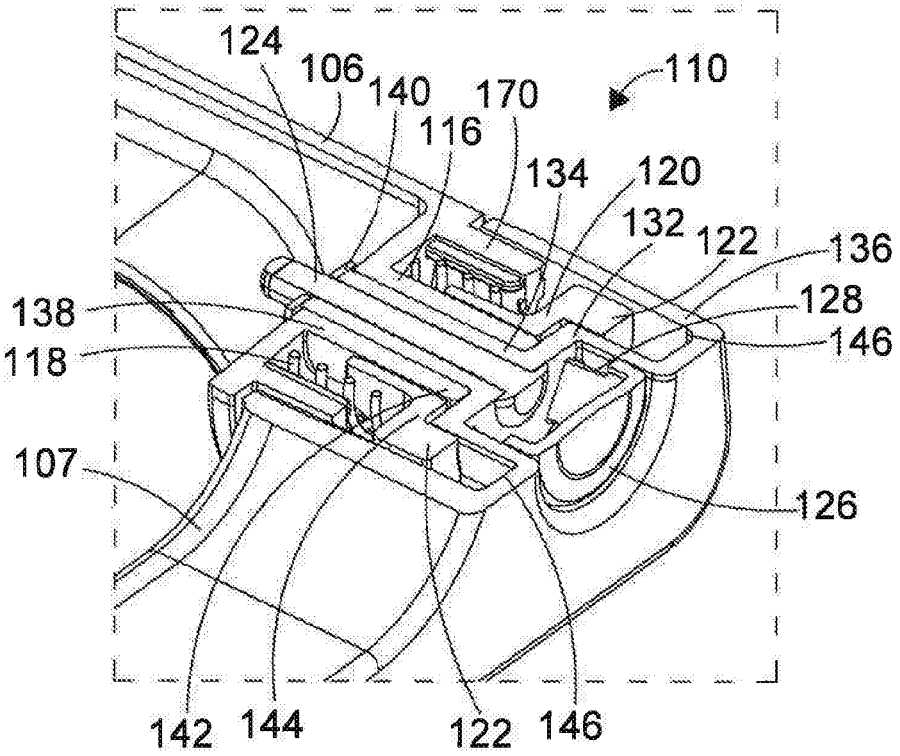
FIG. 18 shows a cutaway view of the locking mechanism employed in the device according to the second embodiment in a locked configuration.
Figure 19:
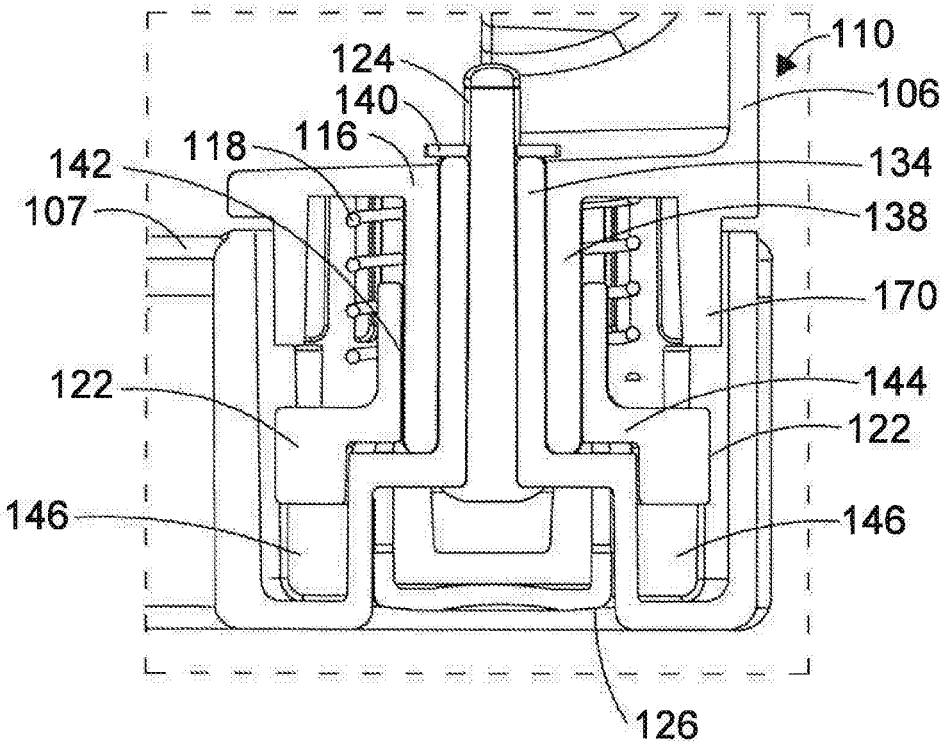
FIG. 19 shows a sectional view of the locking mechanism employed in the device according to the second embodiment in the locked configuration.
Figure 20:
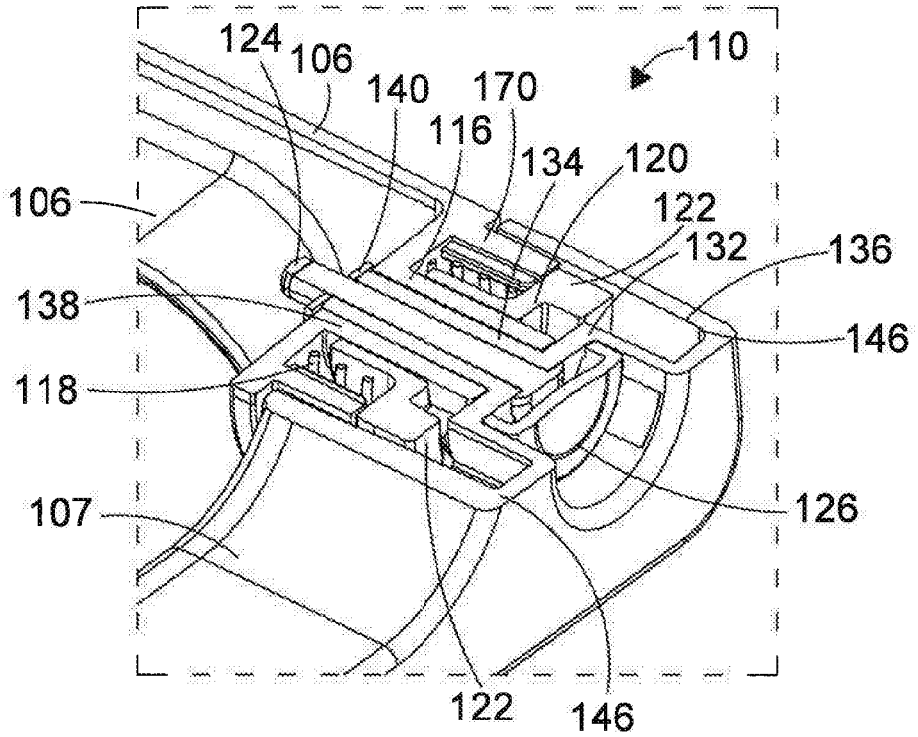
FIG. 20 shows a cutaway view of the locking mechanism employed in the device according to the second embodiment in an unlocked configuration.
Figure 21:
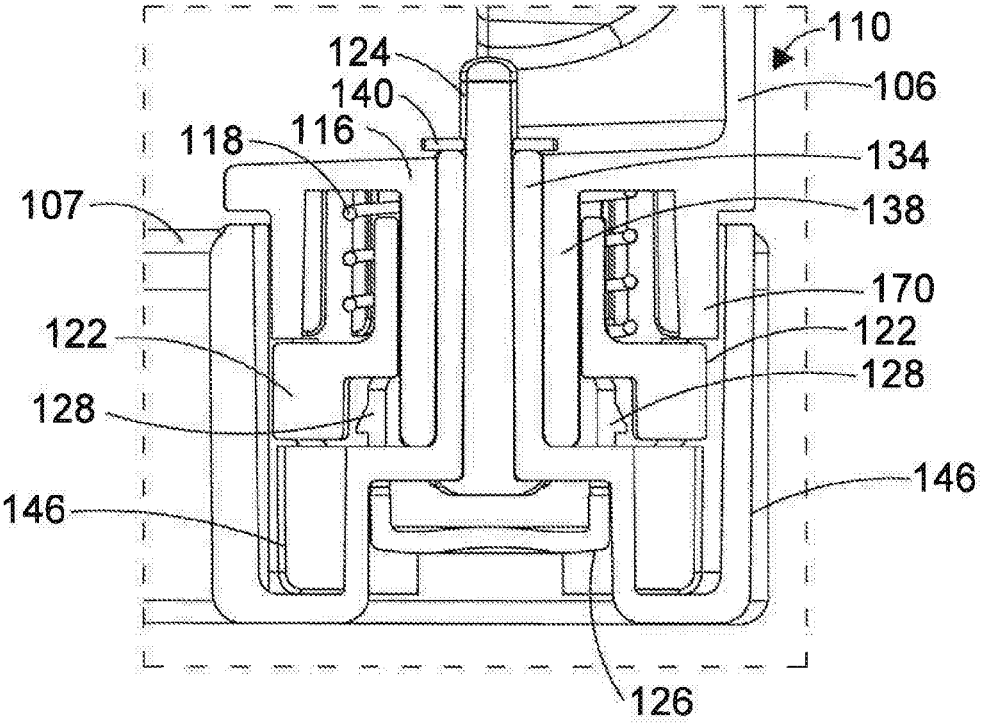
FIG. 21 shows a sectional view of the locking mechanism employed in the device according to the second embodiment in the unlocked configuration.

Referring to FIGS. 18 and 19, the locking mechanism 110 is shown in the assembled state in a locked configuration. In the locked configuration, the at least one connecting element 107 is not permitted to pivot with respect to the rear leg portion 106. As shown the first end 114 of the connecting element 107 comprises an internal hub 132. The internal hub 132 comprises an internal hub cylindrical portion 134 which projects from an internal wall 136 of the first end 114 of the connecting element 107. The internal hub cylindrical portion 134 is located inside an inner cylindrical portion 138 of the rear leg portion hub 116. The two cylindrical portions 134, 138 are coupled to each other by way of the pin 124 and a washer 140.

As shown, the cylindrical portions 134, 138 are located inside of a cylindrical passageway 142 provided in a ring portion 144 of the locking plate 120. Lugs 122 project from the ring portion 114 of the locking plate 120. As shown, the coiled spring 118 is arranged such that it urges the lug 122 into recesses 146 defined by the internal wall 136. When the lugs 122 are located within the recesses 146 no rotational movement of the rear leg portion hub 116 with respect to the internal hub 132 is permitted, and thus the rear leg portion may not pivot with respect to the connecting element 107. However, when the lugs 122 are not located in the recesses 146 rotational movement of the rear leg portion hub 116 with respect to the internal hub 132 is permitted. Therefore when the lugs 122 are not located in the recesses 146, the locking mechanism is in an unlocked configuration, where the rear leg portion 106 may pivot with respect to the connecting element 107.

The locking mechanism 110 may be moved from the locked configuration to the unlocked configuration by pressing the locking button 126. The locking mechanism 110 is shown in the unlocked configuration in FIGS. 20 and 21. The locking button 126 comprises teeth 128 which are arranged to engage the locking plate 120 when the button 128 is pressed so as to urge the locking plate towards the coiled spring 118 such that the lugs 122 are expelled from the recesses 146, thereby allowing the rear leg portion 106 to pivot with respect to the connecting element 107. The teeth 128 are shown engaging the locking plate 120 in FIGS. 20 and 21. The teeth 128 engage the locking plate 120 by passing through apertures 150 provided in the internal wall 136. When the locking button 126 ceases to be pressed the teeth 128 ceased to engage the locking plate 120 and retreat backwards away from the locking plate 120 and coiled spring 118.

Figure 22:
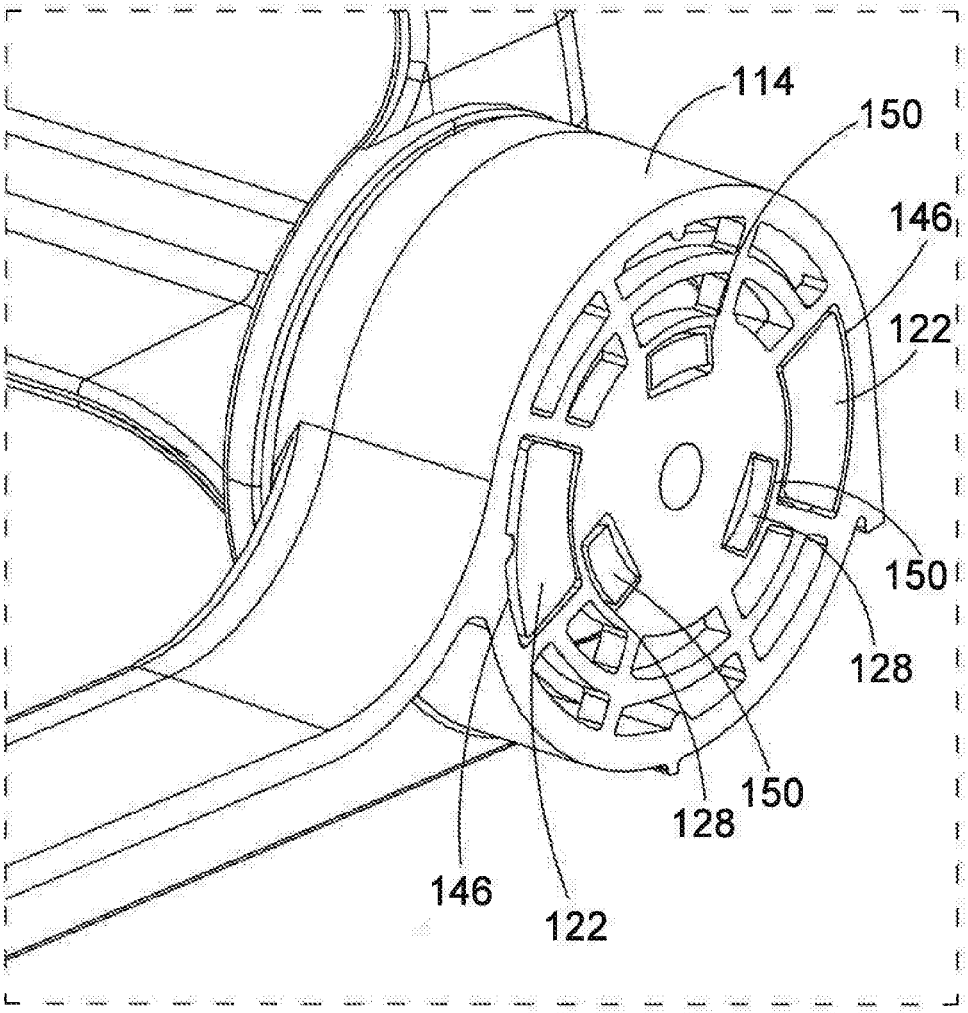
FIG. 22 shows a cutaway view of a part of a first end of a connecting element of the device according to the second embodiment when the locking mechanism is in the locked configuration.
Figure 23:
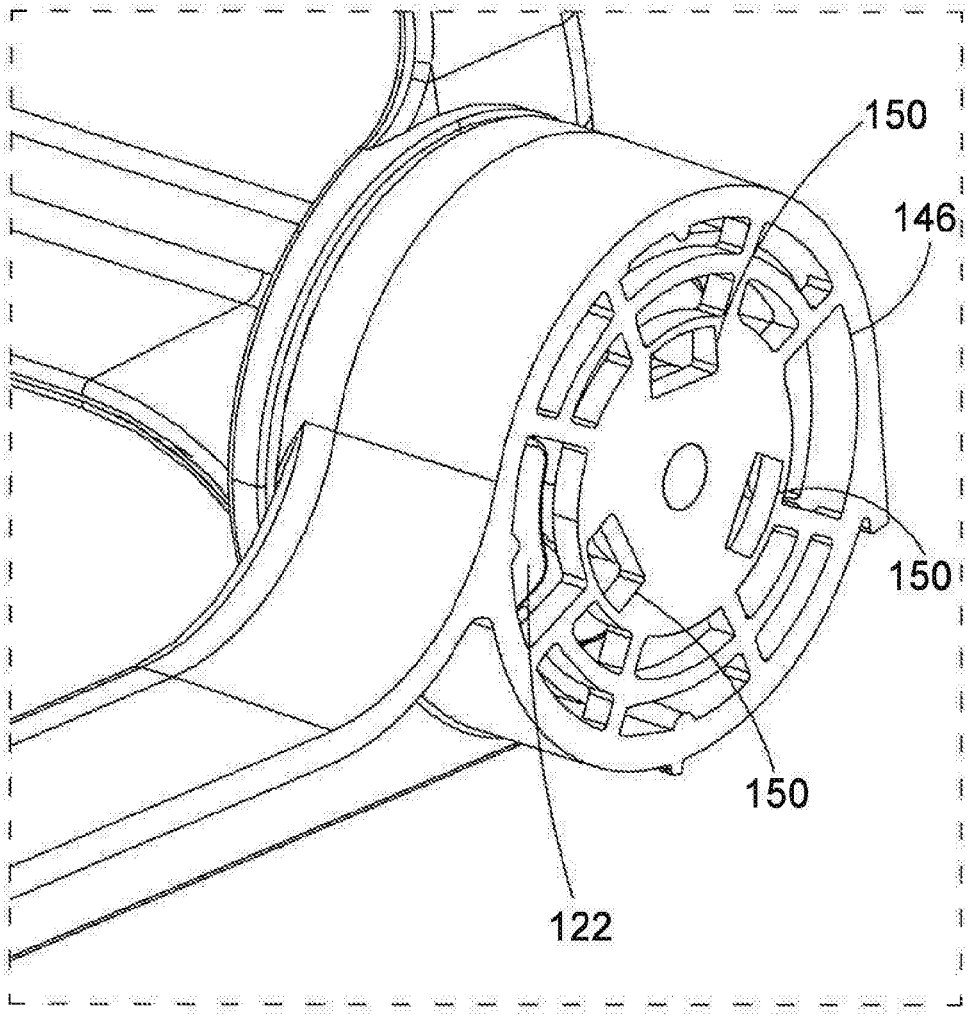
FIG. 23 shows a cutaway view of the part of the first end of the connecting element of the device according to the second embodiment when the locking mechanism is in the unlocked configuration.

The apertures 150 in the internal wall 136 are shown in FIGS. 22 and 23. In FIG. 22, the locking mechanism 110 is depicted in the locked configuration with the lugs 122 in the recesses 146. By contrast, FIG. 23 shows the lugs 122 not in the recesses 146.

Figure 24:
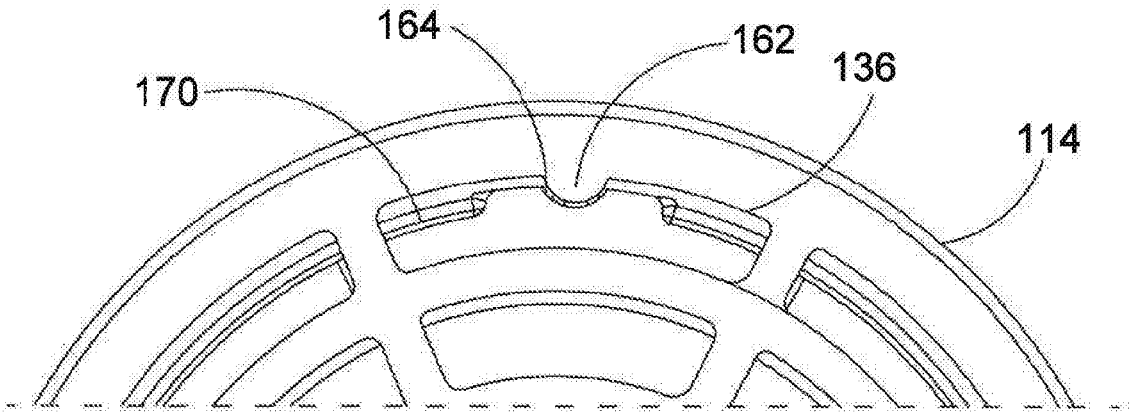
FIG. 24 shows a detail view of a portion of FIG. 23.

As shown in FIG. 24, the internal wall 136 has provided thereon a rib 162. The rib 162 is arranged to engage with a groove 164 provided on an outer surface of an outer cylindrical portion 170 of the rear portion hub 116, which surrounds the cylindrical portion 138 of the rear leg portion hub 116. When the locking mechanism 110 is moved from the locked configuration to the unlocked configuration, and the rear leg portion 106 pivoted with respect to the connecting element 107 to move the device 100 from the erect position to the folded position, the rib 162 locates itself within the groove 164. The rib 162 can only be removed from the groove 164 when the user applies sufficient force to the connecting element 107 and/or rear leg portion 106. The rib 162 and groove 164 arrangement therefore prevent the device 100 from moving out of the folded position unintentionally. In other words, the rib 162 and groove 164 provide a "bump stop".

In use of the device of FIG. 1, a plastic bag with handles (not shown) may be placed in the opening 3. The handles of the bag may be brought over the top of the seat portion 2 and attached to recess portions 7*a*, 7*b*, 8*a*, 8*b* of beams 7, 8 labelled in FIG. 3 or tucked under the seat portion 2. Preferably, the recess portions span at least 50%, more preferably at least 80% of the height of the beams 7, 8, to secure a handle of the bag in place. Advantageously, the toilet device 1 may be pre-loaded with a bag, stored in the folded position and quickly deployed to the erect position as described above.

Figure 12:
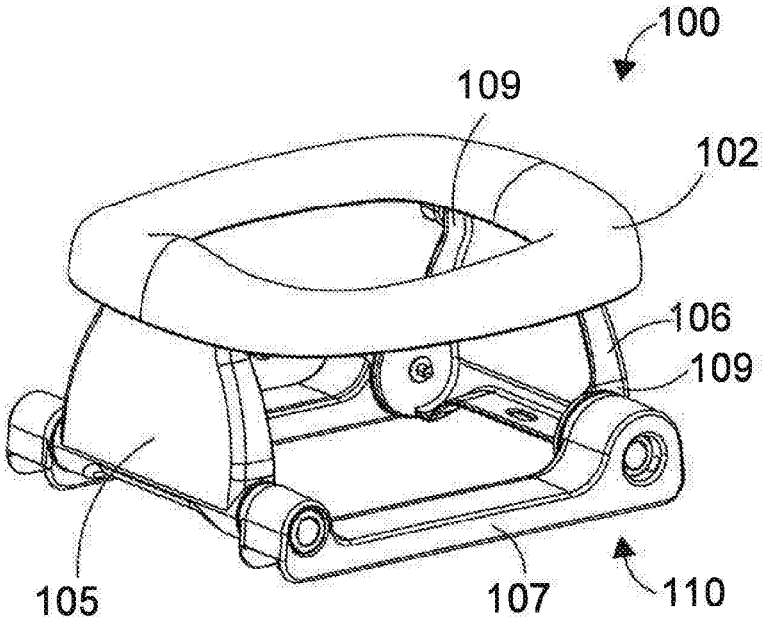
FIG. 12 shows a perspective view of a device according to a second embodiment of the invention in its deployed (erect) configuration.
Figure 13:
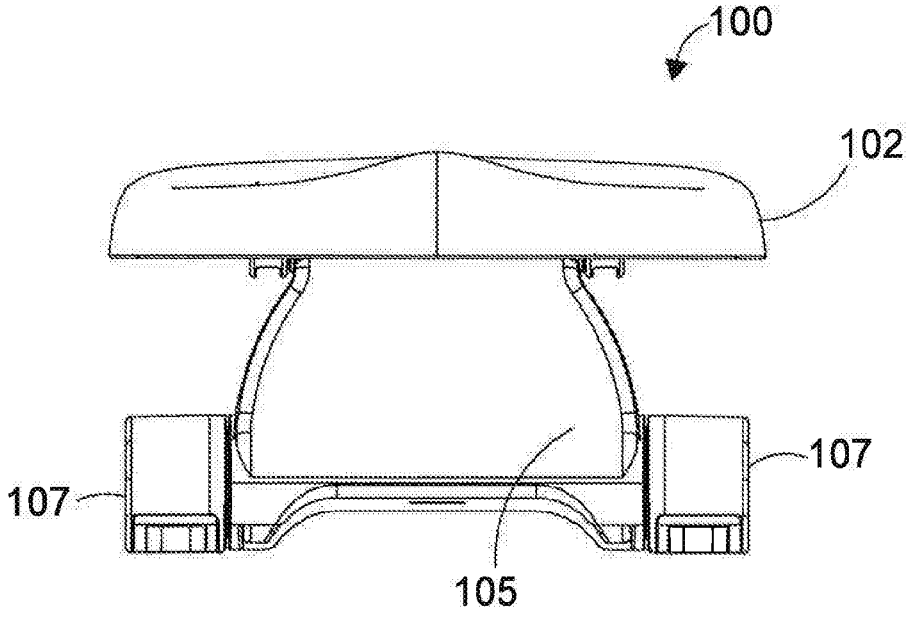
FIG. 13 shows an end view of the device according to the second embodiment in its deployed (erect) configuration.
Figure 14:
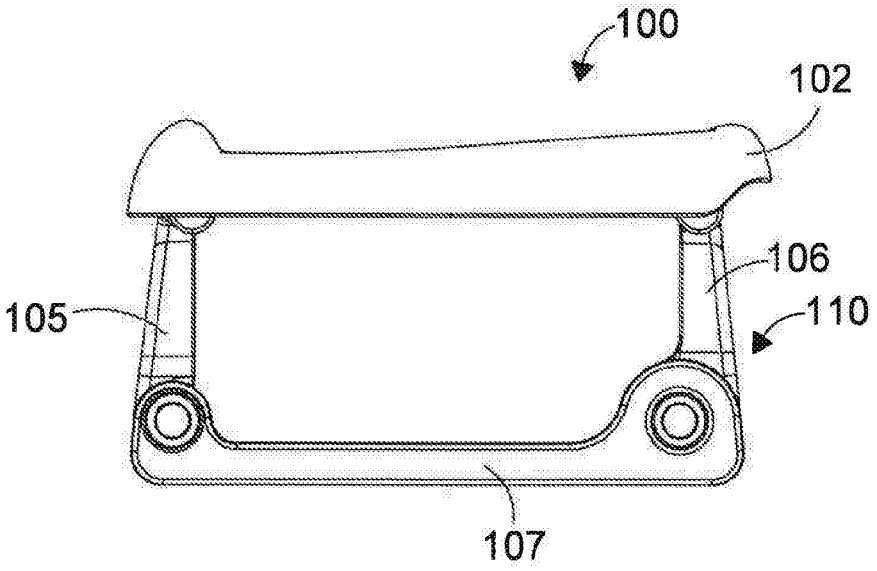
FIG. 14 shows a side view of the device according to the second embodiment in its deployed (erect) configuration.
Figure 15:
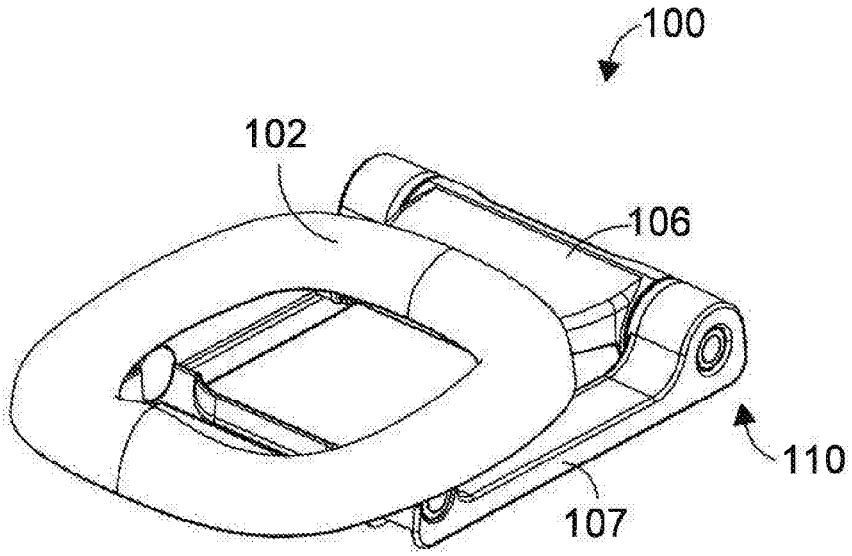
FIG. 15 shows a perspective view of the device according to the second embodiment in its folded configuration.
Figure 16:
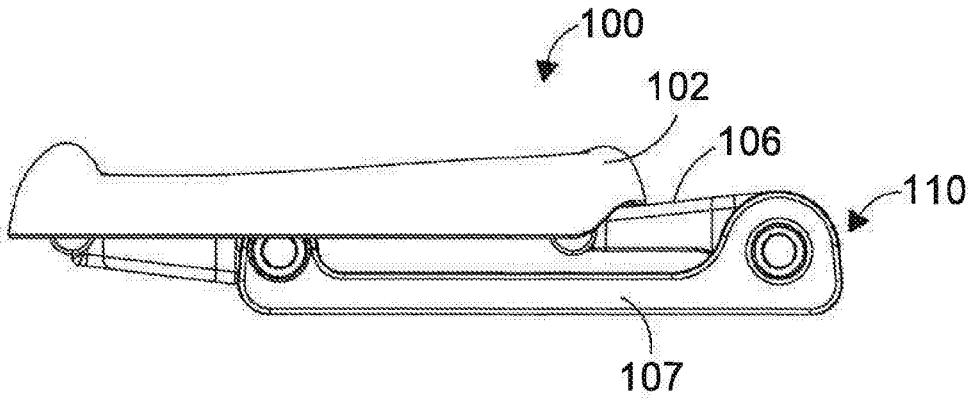
FIG. 16 shows a side view of the device according to the second embodiment in its folded configuration.

The device of FIG. 12 may be used in a similar way with a plastic bag to that of the device of FIG. 1.

The toilet device 1 is usually made of a suitable material such as hard plastics, or any other suitable material. Advantageously, all components of the device 1 may be made from the same material, enabling the product to be recycled. For final recycling the cover plate 63' may need to be unscrewed and the metals removed.

Figure 11:
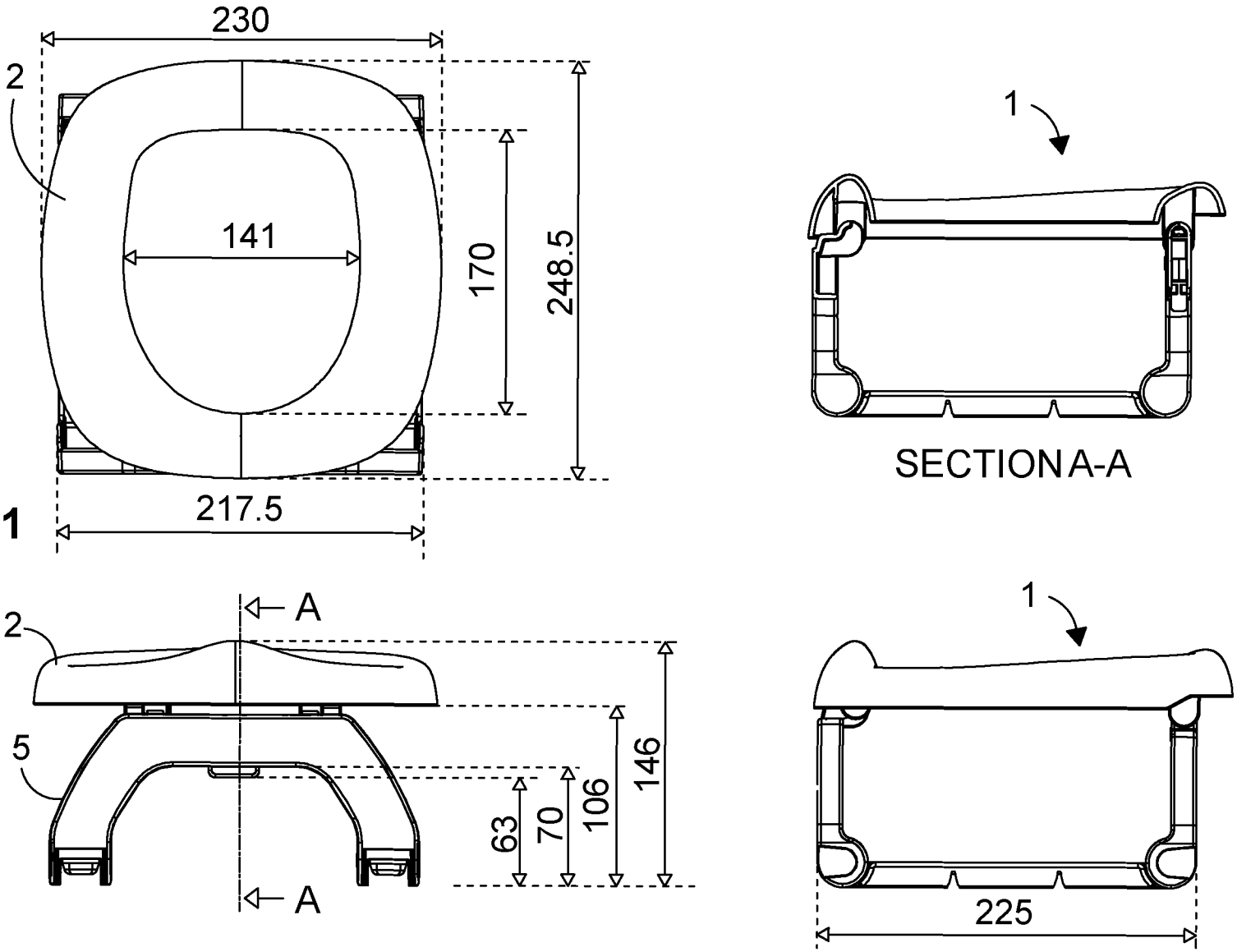
FIG. 11 shows further views of the device of FIG. 1, with exemplary dimensions (in mm)

Exemplary dimensions (in mm) for a device usable as a potty for children toilet training are shown in FIG. 11. It will be appreciated however that the dimensions of the device may vary and larger such portable toilet devices may be constructed for example, as suitable for adults in other use cases.

The invention claimed is:

1. A potty comprising a seat portion and a pair of leg portions attached to opposite ends of the seat portion, wherein a first end of each leg portion is pivotally attached to its respective end of the seat portion so that the leg portions can be deployed from a first, folded configuration of the potty, in which each leg portion extends from its respective first end towards a rear of the potty, towards a second, erect configuration of the potty in which each leg portion extends from its respective first end substantially at right angles to the seat portion, the leg portions being connected by at least one connecting element pivotally connected to a second end of each of the leg portions.

2. A potty according to claim 1, wherein the at least one connecting element comprises: a first end attached to the second end of one of the leg portions; and a second end attached to the second end of the other leg portion.

3. A potty according to claim 1, wherein the leg portions are connected by two connecting elements substantially parallel to the seat portion.

4. A potty according to claim 1, wherein at least one leg portion comprises a locking device for securing said at least one leg portion into the first and/or second configuration.

5. A potty according to claim 4, wherein the locking device is located at the rear of the potty.

6. A potty according to claim 4, wherein the locking device comprises an operating element and at least one pivotable element having a pin portion for engaging with the underside of the seat portion.

7. A potty according to claim 6, wherein the locking device comprises a biasing element for biasing the pin portion to secure said pin portion to the underside of the seat portion.

8. A potty according to claim 4, further comprising detent means for securing the potty in the erect configuration.

9. A potty according to claim 8, wherein the detent means comprise an aperture provided in at least one leg portion and at least one protrusion to be received in the aperture, the protrusion provided in the at least one connecting element pivotally connected to said at least one leg portion.

10. A toilet device according to claim 9, wherein said at least one connecting element comprises at least one recess for receiving a bag handle.

11. A toilet device according to claim 10, wherein the at least one recess has a depth of at least 50% of the height of the at least one connecting element.

12. A potty according to claim 10, wherein the potty rests on the at least one connecting element in the second configuration.

* * * * *